United States Patent [19]

Tomokazu et al.

[11] 3,965,668

[45] June 29, 1976

[54] SHUTTER TYPE DIGITAL CLOCK

[75] Inventors: Suzuki Tomokazu; Doma Katuharu, both of Tokyo, Japan

[73] Assignee: Kabushiki Kaisha Tamura Denki Seisakusho, Japan

[22] Filed: Feb. 28, 1975

[21] Appl. No.: 553,968

[30] Foreign Application Priority Data

Dec. 25, 1974 Japan ..... 50-700

[52] U.S. Cl. ..... 58/126 E; 58/50 R; 58/23 R

[51] Int. Cl.[2] ..... G04B 19/00

[58] Field of Search ..... 58/50 R, 23 R, 125 C, 58/126 E; 40/28 C; 340/373, 336

[56] References Cited

UNITED STATES PATENTS

| | | | |
|---|---|---|---|
| 3,103,007 | 9/1963 | Gumpertz | 340/336 X |
| 3,382,495 | 5/1968 | Christy | 340/336 X |
| 3,399,474 | 9/1968 | Rinder | 40/28 C |
| 3,399,475 | 9/1968 | Rinder | 340/336 X |
| 3,673,787 | 7/1972 | Kovacevic | 58/50 R |
| 3,683,523 | 8/1972 | Boyles | 40/28 C |
| 3,721,087 | 3/1973 | Boyles et al. | 58/50 R X |
| 3,886,725 | 6/1975 | Izawa et al. | 58/50 R |

*Primary Examiner*—Ulysses Weldon
*Attorney, Agent, or Firm*—Martin A. Farber

[57] ABSTRACT

There is provided a shutter type digital clock which comprises generally a display block, a light source block disposed behind the display block and a mechanical block disposed behind the light source block. Each of a plurality of display segment groups of the display block has a plurality of segmental openings arranged in the form of a figure "8" which are mechanically switched to internal light by two vertically movable shutter blades and two horizontally movable shutter blades to display a desired figure. The mechanical block mainly includes an upper frame, a lower frame, an upper cam supporting frame and a lower cam supporting frame, whereby a shifting mechanism is incorporated within a space defined by the upper and lower frames and a plurality of cam controlling mechanisms are incorporated within spaces defined by the upper frame and upper cam supporting frame and by the lower frame and lower cam supporting frame.

10 Claims, 25 Drawing Figures

SHUTTER TYPE DIGITAL CLOCK

FIELD OF THE INVENTION

This invention relates to digital clocks, and more particularly to a shutter type digital clock having a plurality of shutter blades for switching a plurality of display segmental openings arranged in the form of a figure "8".

THE PRIOR ART

Hitherto, digital display units for use in this type of shutter type digital clocks have been disclosed in U.S. Pat. Nos. 3,399,474 Specification (corresponding to Japanese Patent Public Disclosure 13893/1972) and 3,721,087 Specification (corresponding to Japanese Patent Public Disclosure 59867/1973).

According to the U.S. Pat. No. 3,399,474, a display unit comprises four stacked slidable plates made of opaque material which include a plurality of light reflection layers and slits formed on the surface. Accordingly, these slidable plates are controlled to be positioned at either two positions by a suitable actuator in order to display figures reflecting from the light reflection layers. The display unit, however, cannot be reduced into practice with interior light sources and has the following disadvantages. That is to say, in accorcance with the display unit the light reflection layers are illuminated by an incident light passing through openings formed in a base plate disposed in front of the slidable plates and thus a region at which displayed figures i.e. reflected light is limited to a specified one. Further, the reflected light is of a small intensity with the result that a high brightness display is prevented and thus an observation of the displayed figures from a remote place is prevented.

To eliminate these disadvantages of the reflection type display unit, display units with interior light sources have been proposed in the U.S. Pat. Nos. 3,399,474 Specification and 3,721,087 Specification. According to these proposals, the display unit comprises, behind a base plate in which a plurality of display segmental openings in the form of a figure 8 are formed, one shutter blade movable horizontally for switching the display segmental openings arranged vertically and the other shutter blade movable vertially for switching the display segmental openings arranged horizontally. The display unit of this structure is advantageous in that the number of shutter blades is reduced, however, disadvantageous in that the horizontally movable shutter blade is required to be selectively positioned to six positions and the other vertically movable shutter blade to five positions. Therefore, it is necessary to manufacture with high precision cam controlling mechanisms for controlling the shutter blades and slight errors in dimension cause erroneous displays.

SUMMARY OF THE INVENTION

Accordingly, the first object of the invention is to provide a shutter type digital clock with a display unit including the possibly minimal number of shutter blades, wherein the shutter blades are selectively positioned to three positions at most.

To attain the first object, according to the invention, there is provided a shutter type digital clock comprising a display unit base plate in which a plurality of display segment groups each having a plurality of display segmental openings arranged in the form of a figure "8" are formed, a plurality of shutter units disposed behind the display unit base plate for switching the display segmental openings, a plurality of controlling mechanisms for controlling mechanical positions of shutter blades of the shutter units in association with a time-indentified shifting mechanism, and interior light sources disposed behind the shutter blades for internally illuminating the display segmental openings, wherein each of the plurality of shutter units associated with respective, display segment groups comprises a first shutter blade substantially vertically movable for switching an upper segmental opening and a lower segmental opening of the display segmental openings, a second shutter blade substantially vertically movable for switching an intermediate segmental opening of the display segmental openings, a third shutter blade substantially horizontally movable for switching an upper-right segmental opening and an upper-left segmental opening of the display segmental openings, and a fourth shutter blade substantially horizontally movable for switching a lower-right segmental opening and a lower-left segmental opening of the display segmental openings.

A prior art digital clock disclosed in the U.S. Pat. Nos. 3,399,474 Specification and 3,721,087 Specification comprises a plurality of cams supported on plurality of shafts extending in the forward-backward direction behind the display unit base plate, mechanisms for intermittently rotating the shafts, and light sources disposed behind the shutter blades controlled by the cams. The digital clock, however, has disadvantages in that assembling process is sophisticated, dead space is established among component members and thus the size of letters to be displayed is small for the overall area of display panel.

The second object of the invention is to provide a compact shutter type digital clock which is readily fabricated and capable of displaying large figures on a display panel.

Further, a third object of the invention is to provide a reasonable structure of the mechanical block incorporated with structural elements for controlling the plurality of shutters.

To attain the third object, in accordance with the invention, there is provided a shutter type digital clock comprising a display block adapted to display figures by switching a plurality of display segmental openings of a plurality of display segment groups by means of positional controlling of a plurality of built-in shutter units, a light source block disposed behind the display block for illuminating the figures to be displayed, and a mechanical block incorporated with a driven unit, a shifting mechanism driven thereby and a plurality of cam controlling mechanisms for controlling the shutter units in association with the shifting mechanism, wherein the mechanical block includes a lower frame and an upper frame fixed to each other in a vertically spatial relationship, a first cam supporting frame fixed to the lower surface of the lower frame in a spatial relationship thereto, a second cam supporting frame fixed to the upper surface of the upper frame in a spatial relationship thereto, the shifting mechanism incorporated within a first space defined by the upper and lower frames, and a plurality of cams incorporated within a second space defined by the lower frame and the first cam supporting frame and within a third space defined by the upper frame and the second cam supporting frame, the plurality of cams being comprised by the cam controlling mechanisms coupled with preselected members of the shifting mechanism through paw clutches.

The above and other objects and solutions thereof will become apparent from the following detailed description.

BRIEF DESCRIPTION OF THE DRAWINGS

The invention can be more fully understood from the following detailed description taken in conjunction with the accompanying drawings in which.

DETAILED DESCRIPTION OF A PREFERRED EMBODIMENT

Referring now to Figures, one preferred embodiment of the invention will be described which is exemplified by a digital clock so designed as to be incorporated into radios or television receiver sets. A digital clock in accordance with the invention, as shown explodedly in FIG. 9, comprises a display block A, a light source block B disposed behind the display block A and a mechanical block C located behind the light source block B.

Figure 8:
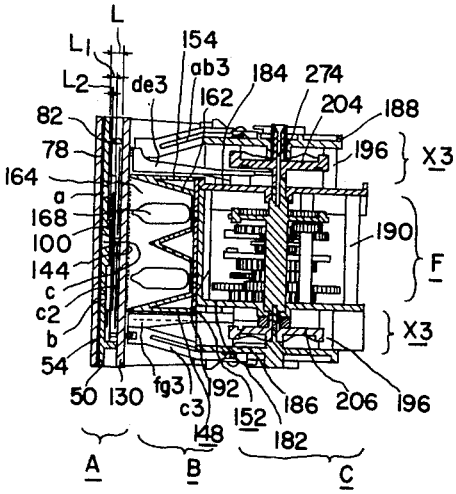
FIG. 8 is a sectional view of the digital clock taken on line VIII—VIII of FIG. 2.
Figure 9:
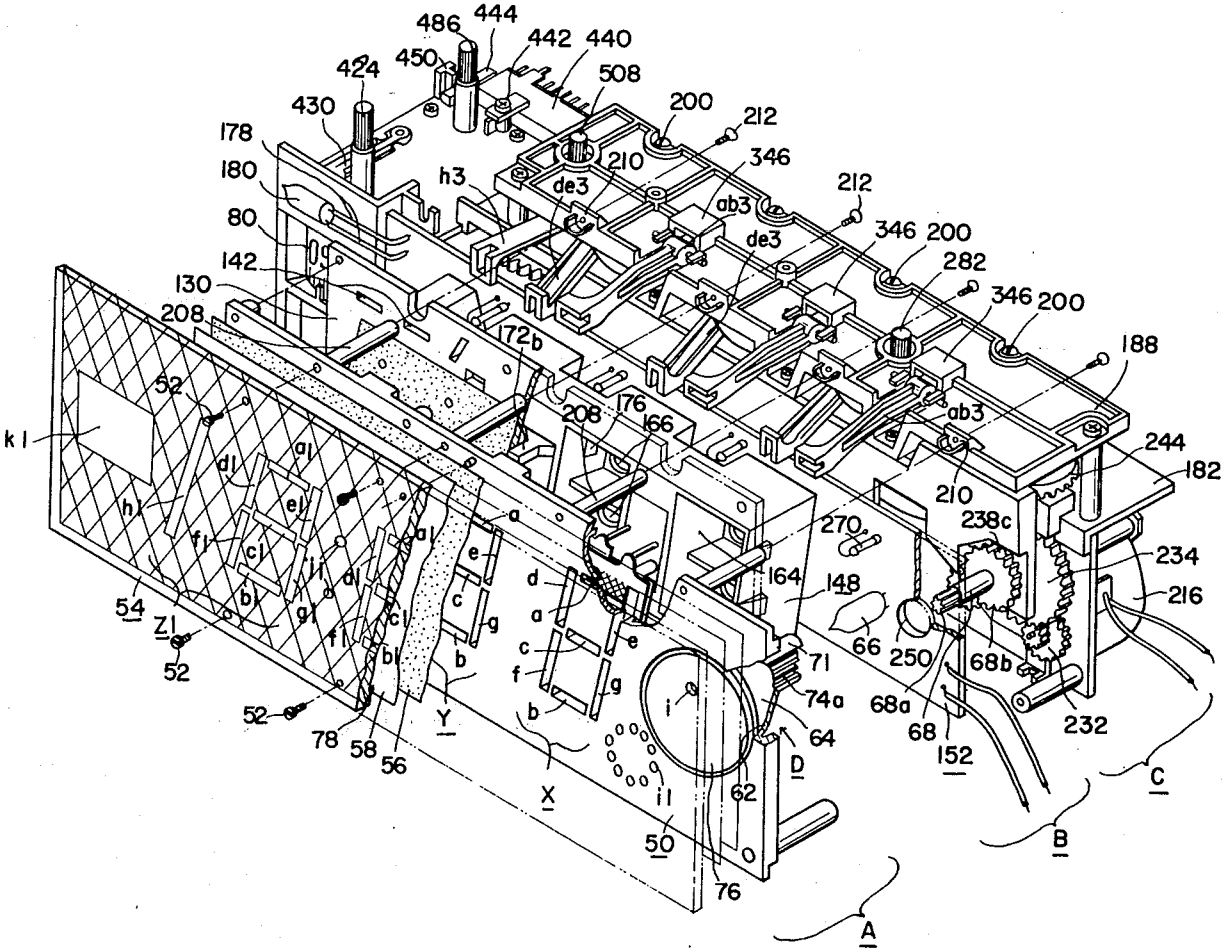
FIG. 9 is an exploded perspective view of the digital clock.
Figure 10:
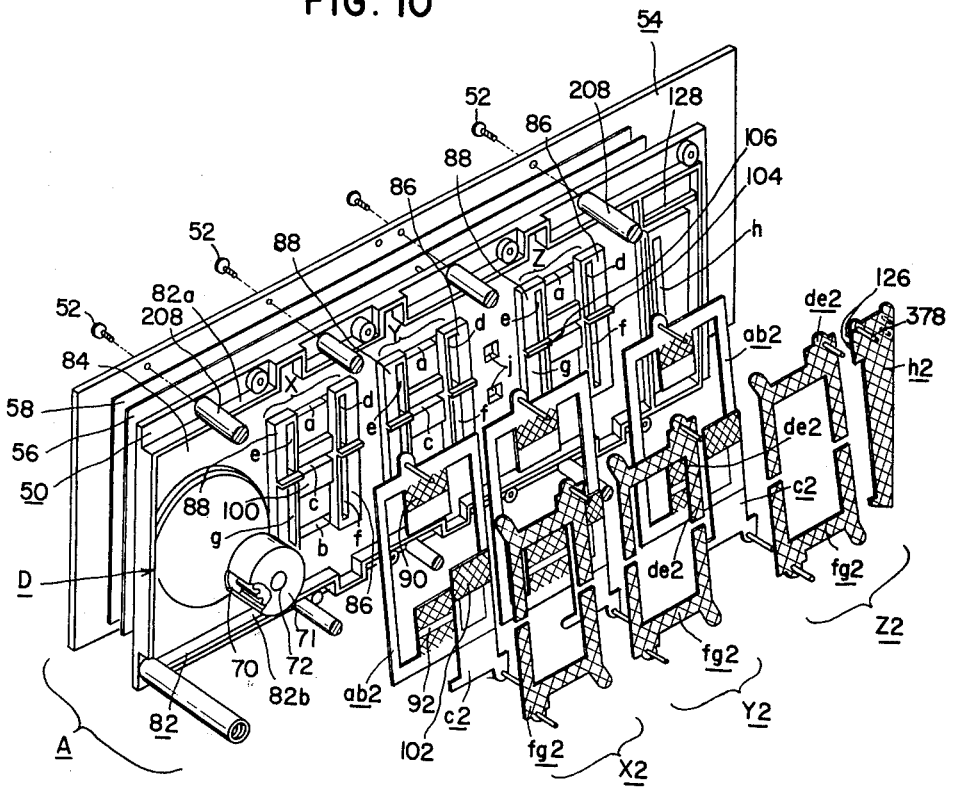
FIG. 10 is an exploded perspective view of a display block as viewed from rear side.

Specifically, the display block A comprises, as shown in FIGS. 9 and 10, a rectangular opaque base plate 50 of the display unit and a front panel 54 fixed by a plurality of screws 52 to the front surface of the base plate 50. Between the base plate 50 and front panel 54 are incorporated, if desired, a light scattering sheet 56 made of a semi-transparent lactescent film or aventurine film and a colour temperature regulating filter 58 made of a desiredly coloured transparent film. In the front surface of base plate 50 are formed three figures 8 in terms of perforation type which adjoin each other in the horizontal direction and which represent a one-minute unit display segment group X, ten-minute unit display segment group Y and hour unit display segment group Z, respectively. Individual of these display segment groups X, Y and Z is optically transparent and comprises an upper segmental opening *a* constituting an upper side of figure 8, a lower segmental opening *b* constituting a lower side thereof, an intermediate segmental opening C constituting an intermediate side of figure 8, an upper-left segmental opening *d* constituting an upper-left side of figure 8, an upper-right segmental opening *e* constituting an upper-right side thereof, a lower-left segmental opening *f* constituting a lower-left side of figure 8, and a lower-right segmental opening g constituting a lower-right side thereof. On the left-hand side of the segmental openings *a* to *g* of hour unit display segment group Z and in adjacency thereto is formed a ten-hour unit display segmental opening *h* which extends substantially in the vertical direction. It should be noted that wordings "front", "behind", "upper", "lower", "right" and "left" herein are defined as viewed from the front of digital clock, i.e. in terms of FIGS. 1 and 9. Further, the display segment groups X, Y and Z in accordance with the invention are not limited to perforation type and openings of these display segment groups may be filled with optically transparent material, for example glass fiber. Preferably, as shown in section in FIG. 8, respective segmental openings *a* to h have a sectional area enlarging outwardly in order to increase the width of each side of the figure to be displayed, thereby ensuring an easy-to-read out display.

Figure 7:
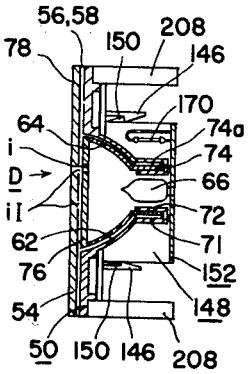
FIG. 7 is a sectional view of the digital clock taken on line VII—VII of FIG. 2.

At the right-hand portion of the base plate 50 of of display unit is installed an operation indicator unit D which is adapted to indicate an operational state of the digital clock. The operation indicator unit D comprises a holder 62 taking the form of a semispherical cell which is molded integrally with the base plate 50, a rotor 64 rotatably mounted within the holder 62, a lamp 66 to be detailed later, and a gear 68 for driving the rotor 64. The holder 62 has a rear cylinder 71 one side portion of which is removed to form a cutting 70. From the bottom of the cylinder 71, a supporing cylinder 72 extends inwardly which is coaxial with the cylinder 71 and has a hollow into which the lamp 66 is inserted. (See FIG. 7.) The rotor 64 in the form of a funnel is provided with a sleeve 74 so that a concentric rotation of the rotor is assured between the cylinder 71 and supporting cylinder 72. Around the outer periphery of sleeve 74 are formed follower teeth 74a exposed to outside through the cutting 70, which follower teeth are meshed with driven teeth 68a of the rotor driving gear 68 (shown in FIGS. 4, 15). The rotor has an opaque light shielding plate 76 in which a perforation *i* eccentric with the center line (not shown) of the sleeve 74 is formed. Accordingly, light emanating from the lamp is transmitted through the perforation *i* and seen from outside.

In the front surface of the base plate 50 are also formed, between the ten-minute unit display segment group Y and one-hour unit display segment group Z, two openings *j* for discriminating an hour display from a minute display.

Figure 1:
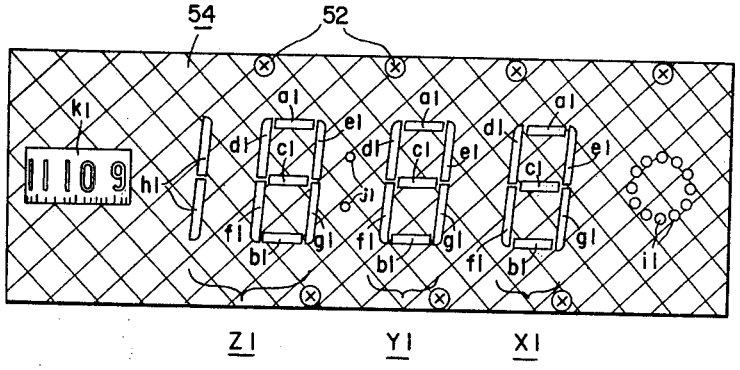
FIG. 1 is a front view of a shutter type digited clock embodying the invention.

The rear surface of the front panel 54 made of a transparent material is deposited with an opaque painting layer 78 illustrated by cross hatching in FIGS. 1 and 9, except for one-minute unit display window group X1, ten-minute display window group Y1 and hour display window group Z1 which are in registration with the display segment groups X, Y and Z, to form a display surface mask. These display window groups X1, Y1 and Z1 comprise a plurality of windows a1 through h1 in registration with the segmental openings *a* through *h*, the dimension of the windows being the same as or slightly less than that of the segmental openings. At the right-hand side portion of the painting layer 78 are formed a plurality of dot windows *i*1 arranged on the locus of the opening *i* so that a continuous movement of the opening *i* can be observed through the dot windows *i*1 in response to a revolutional movement of the rotor 64. In accordance with the present invention, however, the relation between the opening *i* and dot windows *i*1 is not limited in the above way for indicating the operation of digital clock, and by suitably determining the patterns of both the opening and dot windows, flowery patterns or other patterns may be built. The selection from these patterns, however, is a matter of design choice, and not detailed herein. In addition thereto, in the painting layer 78 are formed circular windows j1 in registration with the hour display discriminating openings *j* and a rectangular window *k*1 through which an auxiliary numerical wheel 80 to be described later can be seen.

On the other hand, on the rear surface of the base plate 50 of display unit is provided a rectangular guide frame 82 which is molded integrally with the base plate 50 along the periphery thereof. The guide frame 82 has a height slightly larger than the sum of thicknesses of stacked first to third shutter blades *ab*2, *c*2 and *de*2 to be described later. Inside an extensive but not deep three-dimensional space 84 surrounded by the guide frame 82 are incorporated three shutter units X2, Y2 and Z2 which are associated with the display segment groups *X*, Y and Z. Each shutter unit comprises, in association with one of the display segment source X, y and Z, a first shutter blade ab2 for switching the upper and lower segmental openings *a* and *b*, a second shutter blade c2 for switching the intermediate segmental opening *c*, a third shutter blade *de*2 for switching the two upper-right and left segmental openings *d* and *e*, and a fourth shutter blade *fg*2 for switching the two lower-right and left segmental openings *f* and *g*. The shutter unit Z2 associated with the hour display segment group Z includes, for switching the ten-hour unit display segmental opening *h*, a fifth shutter blade *h*2 selectively movable to a first position at which the segmental opening *h* is opened and to a second position at which the segmental opening *h* is closed.

Figure 12:
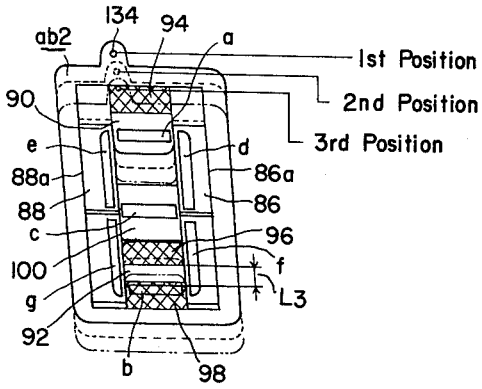
FIG. 12 is an elevation representation, as viewed from rear side, showing relative positions between display segmental openings and a first shutter blade.

The structure of these shutter blades *ab*2, *c*2, *de*2 and *fg*2 and supporting guide means therefor are clearly illustrated in FIGS. 8, 10, 12, 13 and 14. A supporting guide means for the first shutter blade ab2 includes a pair of vertically elongated blocks 86 and 88 embossed from the rear surface of the base plate 50 so as to surround the segmental openings *d*, *f*, *e* and *g*. The vertical blocks 86 and 88 are opposed parallel to each other in the horizontal direction and have each a height L1 (as shown in FIG. 8) of about two-thirds the height L of the guide frame 82. With the vertical blocks 86 and 88 there is engaged the first shutter blade *ab*2 taking the form of a rectangular frame whose inner width is slightly larger than the distance between outer side surfaces 86*a* and 88*a* of the vertical blocks 86 and 88 such that the first shutter blade *ab*2 is slided in the vertical direction. The first shutter blade *ab*2, preferably molded with transparent synthetic resin, has a thickness about onehalf the height L1 of the vertical block 86 and includes a pair of flags 90 and 92 vertically opposed and extending into a space formed between the paired vertical blocks 86 and 88, wherein the upper flag 90 is applied with at its neck a first blind 94 comprised by an opaque painting layer 94. The lower flag 92 is applied with second and third blinds with a space L3 therebetween slightly larger than the width of the lower segmental opening *c*. Such unique structure of the first shutter blade ab2 is achieved in consideration of a nature that the lower segmental opening *b* is required to be closed only concurrently with the upper segmental opening *a* for displaying figures ranging from 0 to 9. Accordingly, as shown in FIG. 12, when the first shutter blade *ab*2 is positioned at a first position (this position corresponds to FIGS. 7 and 9 to be displayed), the lower segmental opening *b* is closed by means of the third blind 98. When the first shutter blade ab2 is positioned at a second position downwardly adjacent the first position (the second position corresponds to FIGS. 2, 3, 5, 6, 8 and 0 to be displayed), both the upper and lower segmental openings *a* and *b* are opened. The first shutter blade ab2 can also be lowered to an extreme at a third position (this position corresponds to FIGS. 1 and 4 to be displayed) at which both the upper segmental opening *a* and lower segmental opening *b* are closed by means of the first and second blinds 94 and 96, respectively.

Figure 13:
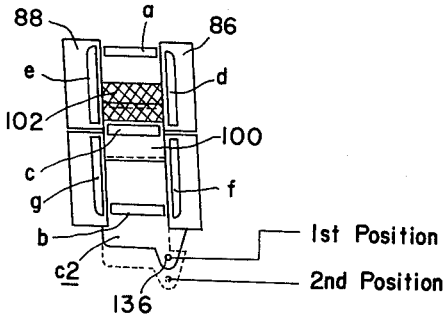
FIG. 13 is an elevation representation, as viewed from rear side, showing relative positions between display segmental openings and a second shutter blade.

Across a spacing between the vertical blocks 86 and 88 is disposed a supporting guide block 100 having a height L2 half the height L1 of the vertical block 86 and surronding the intermediate segmental opening *c*. On the surface of the supporting guide block 100 is stacked a second shutter blade c2 with substantially the same thickness as that of the first shutter blade *ab*2 in such a fashion that the second shutter blade is slidable substantially in the vertical direction. The second shutter blade C2, preferably being a flag made of transparent synthetic resin with width coincident to the spacing between inner side surfaces of the vertical blocks 86 and 88, is applied with a blind 102 of painting layer at its upper end portion. Accordingly, when the second shutter blade c2 is positioned, as shown in FIG. 13 at solid line, at a first position (corresponding to FIGS. 2, 3, 4, 5, 6, 8 and 9 to be displayed), the intermediate segmental opening *c* is opened; when positioned at a second position (corresponding to FIGS. 1, 7 and 0 to be displayed), the intermediate segmental opening *c* is closed by means of the blind 102. It should be noted that the first and second shutter blades *ab*2 and *c*2 according to the present invention have been described by way of example and not limited thereto. They may be constructed in other configurations and with other materials, for example by a metal plate with openings. It is essential that when the movements to the positions as described above are performed, associated segmental openings *a*, *b* and *c* undergo such selective switchings as mentioned through optically light and dark portions. The supporting guide block 100 is effective to eliminate frictional or abrasive affects between the first and second shutter blades and leakage of light beam due to optical diffractive phenomenon and inaccuracy in mounting both the shutter blades. However, it is possible within the spirit of the present invention to support and guide the shutter blades *ab*2, *c*2, *de*2 and *fg*2 by means of well-known guide channels, guide pins and the like.

Figure 14:
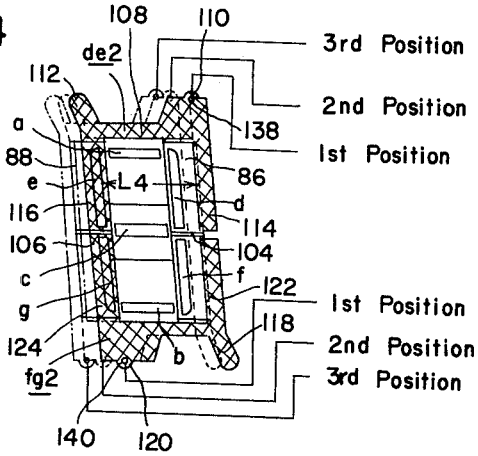
FIG. 14 is an elevation representation, as viewed from rear side, showing relative positions between display segmental openings and third and fourth shutter blades.

On the surface of the vertical blocks stand a pair of guide walls 104 and 106 extending in the horizontal direction between the upper-left segmental opening *d* and lower-left segmental opening *f* and between the upper-right segmental opening *e* and lower-right segmental opening *g*. Between the guide walls 104 and 106, having a height one-third the height L of the guide frame 82, and an upper side 82*a* of the guide frame 82 is disposed a third shutter blade *de*2; similarly, between the guide walls and a lower side 82*b* of the guide frame 82 is disposed a fourth shutter blade *fg*2, whereby both the third and fourth shutter blades are movable in the horizontal direction. Preferably, the third shutter blade *de*2 is made of an opaque synthetic resin plate having a thickness slightly less than the height of the guide walls 104 and 106. The third shutter blade de2 is formed into an inverse U letter configuration having an upper side 108 from which a pair of projections 110 and 112 extend upwardly which in turn make engagement with a horizontal guide recess (not shown) formed in the inner side surface of the upper side 82*a* of guide frame 82. The third shutter blade *de*2 is realized in consideraton of the fact that the upper-left and right segmental openings *d* and *e* are not needed to be closed simultaneously for displaying figures ranging from 0 to 9. The third shutter blade *de*2 has first and second side blinds 114 and 116, and an inner distance L4 therebetween is determined to be slightly larger than an outer distance between the upper-left and right segmental openings *d* and *e*. Accordingly, when the third shutter blade de2 is positioned at a first position as shown in FIG. 14 at solid line (this position corresponds to FIGS. 5 and 6 to be displayed), the upper-right side segmental opening *e* is closed by means of the second side blind 116.

The third shutter blade de2 is also allowed to be positioned at a second position (corresponding to FIGS. 4, 8, 9 and 0 to be displayed) where both the upper-left and right segmental openings *d* and *e* are opened, and at a third position (corresponding to FIGS. 1, 2, 3 and 7 to be displayed) horizonally adjacent the second position where the upper-left side segmental opening *d* is closed by means of the first side blind 114.

The fourth shutter blade *fg*2 is preferably made of the same material as the third shutter blade *de*2 and formed into the same configuration and dimension as the shutter blade *de*2. In other words, the third shutter blade de2 stands for the fourth shutter blade *fg*2 when reversed to take the form of U letter. The fourth shutter blade *fg*2 has a lower side from which a pair of projections 118 and 120 extend downwardly which in turn make engagement with a horizontal guide recess formed in the inner side surface of the lower side 82*b* of guide frame 82. Like the third shutter blade de2, the fourth shutter blade *fg*2 is realized in consideration of the fact that the lower-left and right segmented openings *f* and *g* are not needed to be closed simultaneously and has first and second side blinds 122 and 124, the inner distance L4 therebetween being slightly larger than an outer distance between the lower-left and right segmental openings *f* and *g*. Accordingly, when the fourth shutter blade *fg*2 is positioned at a first position as shown in FIG. 14 at solid line (corresponding to FIG. 2 to be displayed), the lowerright side segmental opening *g* is closed by means of the second side blind 124. The fourth shutter blade fg2 is also allowed to be positioned at a second position (corresponding to FIGS. 6, 8 and 0 to be displayed) where both the lower-left and right side segmental openings *f* and *g* are opened, and at a third position (corresponding to FIGS. 1, 3, 4, 5, 7 and 9 to be displayed) horizontally adjacent the second position where the lower-left side segmental opening *f* is closed by means of the first side blind 122. Although the third and fourth shutter blades *de*2 and *fg*2 have been described by way of an opaque plate in the form of a reversed U-letter and U-letter, respectively, they may be made of optically transparent rectangular plates applied with opaque painting layers at the blind portions 114, 116, 122 and 124. The fifth shutter blade *h*2 is provided, on the front surface thereof, with paired slide pins 126 (shown in FIG. 10) which make engagement with a guide 128 extending in the horizontal direction on the base plate 50, whereby the shutter blade h2 is movable in the horizontal direction along the guide 128.

The display block A also comprises a transparent lid plate 130 as shown in FIGS. 2, 7, 8 and 9. The lid plate 130 is fixed to the base plate 50 of display unit by means of screws 132 shown in FIG. 2 after all of the shutter units X2, Y2 and Z2 are installed within the space 84 (FIG. 10) behind the base plate 50. The shutter blades ab2, c2, *de*2 and *fg*2 of individual shutter units X2, Y2 and Z2 have respectively follower pins 134, 136, 138 and 140 extending backward. These follower pins 134, 136, 138 and 140 project toward the rear side surface of the lid plate 130 through slots 142 (shown in FIG. 9) formed in the lid plate 130 in registration with the shutter blades so as to make engagement with cam followers to be described later. The lid plate 130 is also applied, at its central portion on the rear surface, with an aventurine layer 144 (shown in FIG. 8) which is effective to scatter and regularize the light from the light source block B to be described later. The lid plate 130 further includes a plurality of paws 146 (shown in FIG. 7) which extend backward from peripheral portions on the rear surface of the lid plate 130. These paws 146 resiliently engage associated triangular projections 150 formed on the peripheral surface of a lamp house 148 to be described later.

Figure 11:
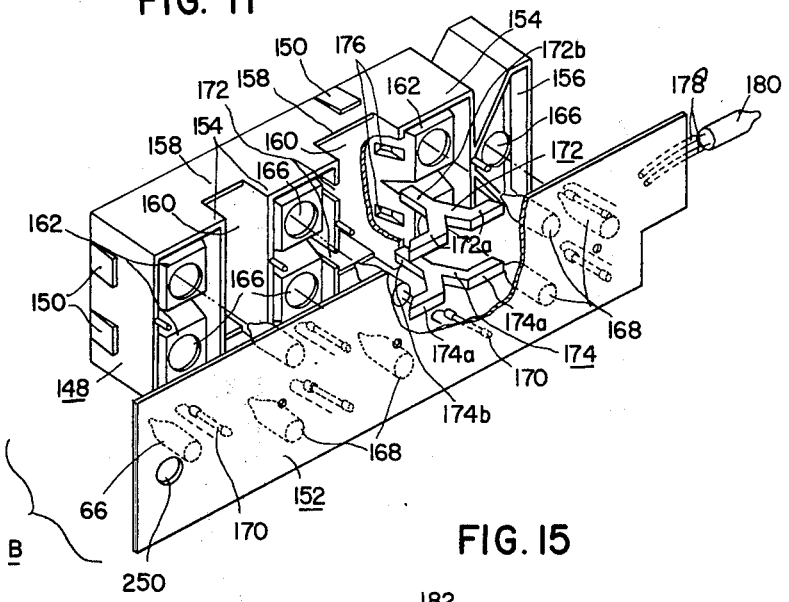
FIG. 11 is an exploded perspective view of a light source block as viewed from rear side.

The light source block B, as shown in FIG. 11 being an exploded view thereof as viewed from rear side, includes a lamp house 148 of a suitable synthetic resin material in the form of a box, and a printed circuit board 152 fixed to the rear surface of lamp house 148. The lamp house 148 includes three light shielding frames 154 of rectangular section which are aligned behind the display segment groups X, y and Z in association therewith, and one light shielding frame 156 of a triangular section which is also aligned behind the ten-hour unit segmental opening *h*. Individual light shielding frames 154 are coupled with each other by means of a pair of coupling walls opposed vertically to form circuit element chambers 160 surrounded by the shielding frames 154 and coupling walls 158. Within each light shielding frame 154 is disposed a reflector wall structure 162 which is spread out in the forward direction and which is coated with a reflecting layer on its inner surface by vacuumdeposition, for example.

Accordingly, within the light shielding frames 154 are formed lamp chambers 164 in the form of a pyramid trapezoid coupled with each other, each lamp chamber being surrounded with the reflector wall structure 162 and opened in the forward direction. In a rear wall of each reflector wall structure 162 is formed one through-hole 166. In this manner, seven lamps 168 associated with the through-holes 166 are provided on the front surface of the printed circuit board 152. Incandescent lamps of long lifetime are available for these lamps, but preferably semi-permanent lifetime lamps such as high illumination neon tubes are employed. On the other hand, attached to the front surface of the printed circuit board 152 are circuit elements such as load resistors 170 associated with lamps 66 and 168. These circuit elements are preferably housed in either the remaining space between the light shielding frames 154 or in the circuit element chambers 160. This arrangement ensures a compact and easy-to-fabricate light source block B.

In adjacent side walls of the light shielding frames 154 are formed two pairs of slots 172 (shown in FIG. 11) which are opposed in the horizontal direction.

Held in the paired slots 172 are branching portions 172*a* and 174*a* of paired light conductive members 172 and 174 in the form of T letter. The light conductive members 172 and 174 of total reflective material such as glass fiber or transparent material such as acrylic material have the branching portions 172*a* and 174*a* extending through holes 176 formed in the reflector wall structure 162 into the lamp chambers 164 (FIG. 9). Stem portions 172*b* and 174*b* of the light conductive member 172 and 174 extend toward the base plate 50 of the display unit and go through holes (not shown) formed in the lid plate 130 to reach the hour discriminating openings j1. Accordingly, when the digital clock is in use, a part of light quantity from the lamp 168 disposed in the lamp chamber 164 is directed into the light conductive member 172 and 174 through the branching portions 172*a* and 174*a*, and then the light radiated from the stems 172*b* and 174*b* can be seen through the circular windows *j*1 of the front panel 54.

It will be understood that the light conductive members 172 and 174 reduce the number of lamps and illumination power as well as manufacturing cost.

On the right-hand portion of the printed circuit board 152 is disposed the lamp 66 which faces the cylinder 71 of the operation indicator unit D. To the left-hand side portion of the printed circuit board 152 is mounted a lamp 180 carried by conductors 178. The lamp 180 is adapted to illuminate the auxiliary numerical wheel 80 for timer which will be described later.

Figure 15:
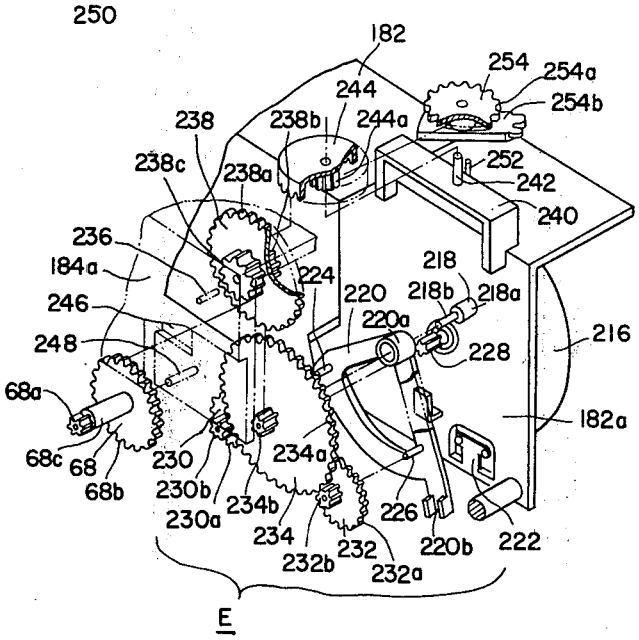
FIG. 15 is an exploded perspective view of a driver unit as viewed from front.
Figure 22:
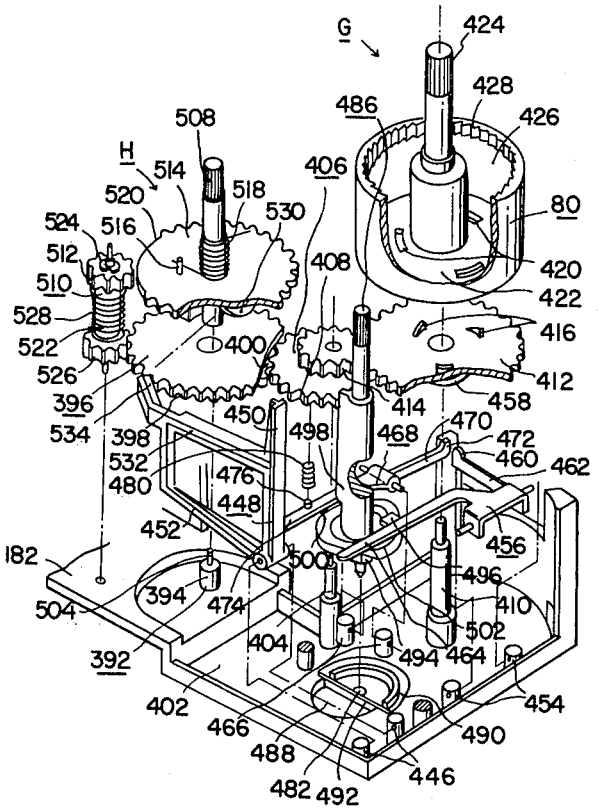
FIG. 22 is an enlarged and exploded perspective view of a timer and sleep mechanism.

The mechanical block C includes a driver unit E as shown in FIG. 15 to be mounted to a mechanical frame to be described later, cam controlling mechanisms X3, Y3 and Z3 respectively associated with the shutter units X2, Y2 and Z2, a shifting mechanism F linked with the cam controlling mechanisms X3, Y3 and Z3, a timer G as illustrated in FIG. 22, and a sleep mechanism H related to the timer G. The mechanical block C further includes a mechanical frame with which the functional elements E, F, G, H, X3, Y3, and Z3 are assembled. The mechanical frame essentially consists of a lower frame 182 and upper frame 184 which are spaced in the vertical direction in parallel relation, a lower cam supporting frame 186 below the lower frame 182, and an upper cam supporting frame 188 above the upper frame 184.

The lower frame 182, as shown in FIG. 8, is of L-letter section on the upper surface of which a plurality of posts 190 and a plurality of posts 192 stand vertically in alignment with each other along rear and front edges. The upper frame 184 is fixed tightly to the tips of the plurality of posts 190 and 192 by means of screws 194 (shown in FIG. 2), whereby the lower and upper frames 182 and 184 define a space into which the shifting mechanism F is incorporated. On the lower surface of the lower frame 182 and on the upper surface of the upper frame 184 stand a plurality of short posts 196 extending in the vertical direction, and along the front edges of the lower and upper cam supporting frames 186 and 188 are molded integrally therewith a plurality of legs 198 in the form of U-letter. Accordingly, the cam supporting frames 186 and 188 can be fixed to the lower and upper frames 182 and 184, respectively, through the posts 196 and legs 198 to which screws 200 and 202 are applied. As described later, within a space defined by the upper frame 184 and cam supporting frame 188 and within another space defined by the lower frame 182 and cam supporting frame 186 are incorporated three cams 204 and three cams 206, respectively, which cams constitute the cam controlling mechanisms X3, Y3 and Z3.

On the other hand, on the rear surface of the base plate 50 of display unit stand a plurality of spacer columns 208 along the upper and lower edges thereof in alignment with each other, the spacer columns 208 being extended toward the cam supporting frames 186 and 188. The cam supporting frames 186 and 188 have each a plurality of ears 210 which face the spacer columns 208, whereby the display block A is fixed tightly to the mechanical block C by means of a plurality of screws 212 which are applied to the ears 210. With this construction, after independent completions of the display block A, light source block B and mechanical block C are accomplished, the light source block B is readily mounted to the display block A by means of engaging paws 146 and then the display block A to the mechanical block C.

Figure 3:
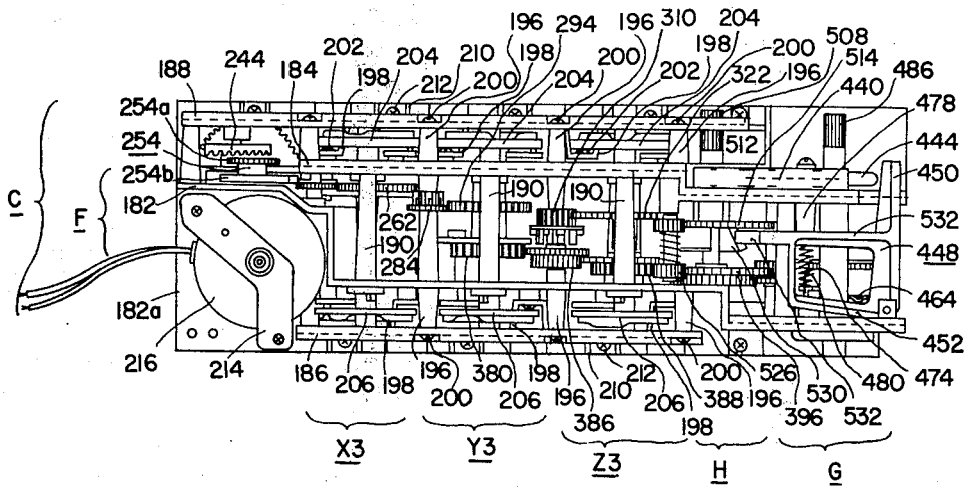
FIG. 3 is a rear side view of the digital clock.
Figure 4:
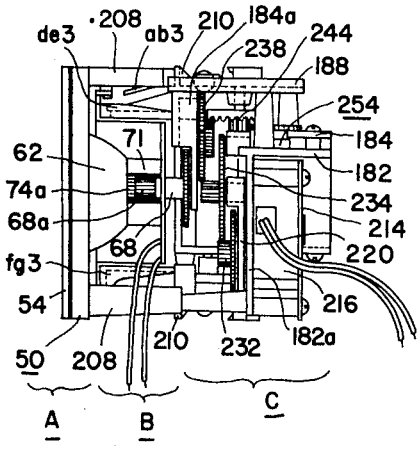
FIG. 4 is a rightside view of the digital clock.
Figure 6:
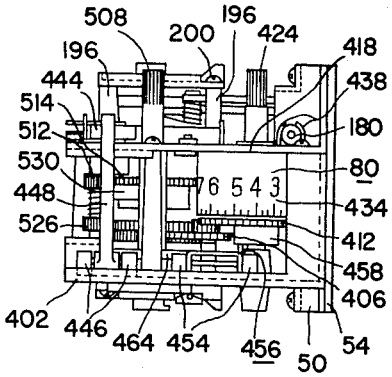
FIG. 6 is a left-side view of the digital clock.
Figure 16:
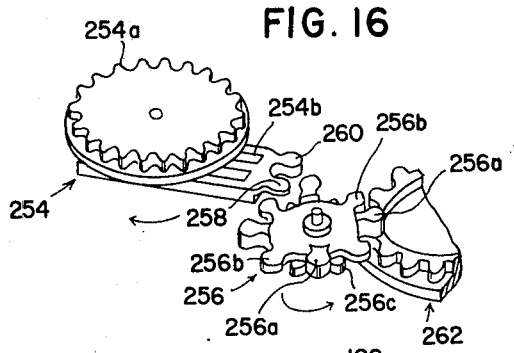
FIG. 16 is an enlarged perspective view showing relation between driver members and a shifting pinion.

The lower frame 182 is provided, as shown in FIGS. 4, 9 and 15, with at its right end a vertical mounting wall 182*a* the rear surface of which is mounted with a driver motor 216 by means of a fixture 214 in the form of L-letter shown in FIG. 3. The driver unit E is illustrated in FIG. 15 which is mounted to the mounting wall 182a another mounting wall 184*a* of the upper frame 184 positioned in front of the mounting wall 182*a*. The mounting wall 182a is provided with a shaft 218 consisting of a large-diameter portion 218*a* and small-diameter portion 218*b*. To the large-diameter portion 218*a* is rotatably mounted a stem 220*a* of a cycle transferring member 220. The cycle transferring member 220, transferable angularly between two positions determined by click paws 222 which constitute a part of the mounting wall 182*a*, includes finger stoppers 220*b* projecting below the mounting wall 182*a*. The transferring member 220 includes a pair of pins 224 and 226 projecting forwardly from the surface thereof. The pins 224 and 226 support respectively cycle transferring gears 230 and 232 selectively meshing with a driver shaft pinion 228 of the driver motor 216. The cycle transferring gears 230 and 232 include respectively follower teeth 230*a* and 232*a* of different tooth number selectively meshing with the driver shaft pinion 228 dependent on angular positions of the transferring member 20. Small-diameter driver teeth 230b and 232*b* of the cycle transferring gears 230 and 232 are always meshed with large-diameter follower teeth 234*a* of reduction gear 234 rotatably supported on the smalldiameter portion 218*b* of the shaft 218. An intermediate gear 238 supported on a rear side pin 236 of the mounting wall 184*a* of the upper frame 184 has follower teeth 238*a* meshing with small-diameter driver teeth 234*b* of the reduction gear 234. The intermediate gear includes two driver teeth 238*b* and 238*c*, the driver teeth 238*b* of which are meshed with a crown gear 244 supported on a central shaft 242 of a mounting block 240 provided on the mounting wall 182*a*. A portion of the other driver teeth 238*c* are exposed to the front of the mounting wall 184*a* through a window 246 formed in the mounting wall 184*a*, the driver teeth 238*c* being meshed with follower teeth 68*b* of the operation indicator driving gear 68 supported rotatably on a pin 248 of the mounting wall 184 *a*. The operation indicator driving gear 68 has a shaft 68c extending forwardly through a window 250 (shown in FIG. 11) of the printed circuit board 152. At the tip portion of the shaft 68c are formed driver teeth 68*a* to be meshed with follower teeth 74*a* of the rotor 64. On the other hand, the crown gear 244 includes a driver teeth 244*a* meshing with a follower gear 254*a* of a driver member 254 supported rotatably on a vertical pin 252 of the lower frame 182. The driver member 254 has a stem 254*b* extending horizontally whose tip is provided wtih two shift teeth 258 and 260 to be meshed with a first digit shifting pinion 256 which constitutes a portion of the shifting mechanism F. One of the shift teeth 258 and 260, i.e. the tooth 258 preceding in the rotation direction of the driver member 254, as exaggeratedly shown in FIG. 16, has a thickness about half the other tooth 260. The shifting pinion 256 includes a plurality of follower teeth 256*a* with a proper thickness for meshing with both the teeth 258 and 260, and a plurality of follower teeth 256b interposed between the follower teeth 256*a* and having a thin thickness for meshing only with the shift tooth 260. The shifting pinion 256 has also driver teeth 256*c* adapted to mesh with a first advance gear 262 generally illustrated in FIG. 5.

The advance gear 262, constituting a part of the shifting mechanism F, includes a rotary shaft 270 bridging across and through one paired shaft holes 264*a* and 264*b* among three paired shaft holes 264*a* and 264*b*, 266*a* and 266*b*, and 268*a* and 268*b* opposed vertially, the shaft holes 264*a*, 266*a*, 268*a* being formed in the lower frame 182 and other shaft holes 264*b*, 266*b* and 268*b* in the upper frame 184. Also, the cam supporting frames 186 and 188 include a plurality of pins 272 which extend in the vertical direction at positions facing the shaft holes 264*a*, 264*b*, 266*a*, 266*b*, 268*a* and 268*b*, on which pins 272 the plurality of cams 204 and 206 respectively are supported rotatably, the cams 204 and 206 being included in the cam controlling mechanism X3, Y3 and Z3. On the other hand, the rotary shaft has a metallic central shaft 274 at the upper end, to which one cam 204 of the cam controlling mechanism X3 is inserted loosely. Also, the shaft 270 has paws 276 at both the upper and lower ends which constitute paw clutches, the paws 276 being respectively engaged with paws 278 of the cams 204 and 206 of the cam controlling mechanism X3 corresponding to the one-minute unit display segment group X.

In the cam supporting frame 188 is formed a window 280 facing the shaft hole 264*b* of the upper frame 184. Though the window 280, a time adjusting shaft 282 of the cam 204 projects above the cam supporting frame 188. Accordingly, when shifting pinion 256 is disengaged from the driver member 254, the time adjustment can be accomplished by manually turning the time adjusting shaft 282. It happens that a rough time adjustment or mechanical vibrations prevent the shifting pinion 256 from being positioned at a predetermined position. Even in such an event, the thin driver teeth 258 of the driver member 254 makes a steady engagement with the thick follower teeth 256a of shifting pinion 256 so that the shifting pinion is moved to the predetermined position. In other words, since a specified tooth of the shifting pinion 256 is engaged with a specified tooth of the driver member 254, an erroneous display due to deviation of indexing positions of the cams 204 and 206 in the rotational direction thereof is prevented.

Figure 5:
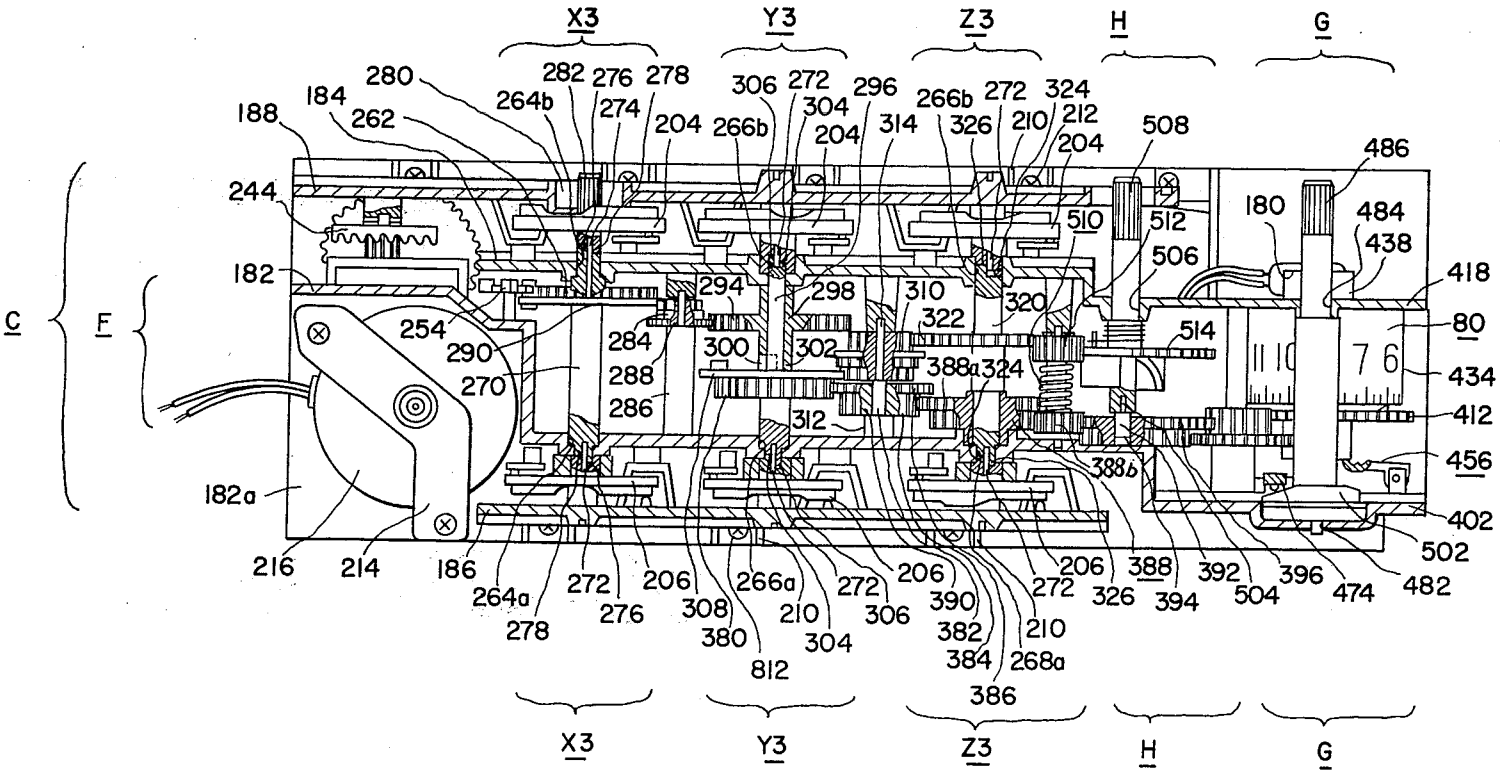
FIG. 5 is a enlarged sectional view of the digital clock taken on line V—V of FIG. 2.
Figure 17:
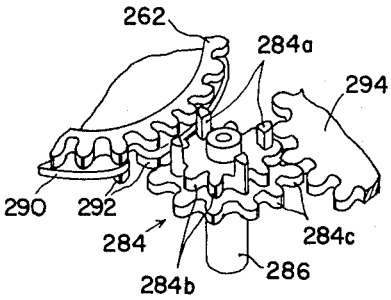
FIG. 17 is an enlarged perspective view of a second shifting pinion and related gears.

The shifting mechanism F includes, as shown in FIGS. 5 and 17, a second shifting pinion 284 which is supported rotatably on a pin 288 of shaft 286 located on the upper surface of the lower frame 182. The shifting pinion 284 has a plurality of lock teeth 284*a* which come in contact with the periphery of locking disk 290 of the advance gear 262 which is advanced by 36° by means of the driver member 254. The shifting pinion 284 also includes follower teeth 284*b* located on the same level as segmental gear 292 which is formed on a partial area of the rear surface of the locking disk 290. Furthermore, the shifting pinion 284 includes driver teeth 284c in engagement with advance gear 294. The advance gear 294 includes a sleeve 298 mounted on a center shaft 296 rotatably supported between the shaft holes 266*a* and 266*b*. The sleeve 298 has a paw 302 in engagement with the clutch paw 300 integral with the center shaft 296. With the aid of engagement of the clutch paw 300 with paw 302, the advance gear 294 is rotated in unison with the center shaft 296. The center shaft 296 includes clutch paws 306 at both ends thereof which mesh with clutch paws 304 of two cams 204 and 206 of the cam controlling mechanism Y3 corresponding to the ten-minute unit display segment group Y. Accordingly, one rotation of the advance gear 294 turns (advances) the cams 204 and 206 intermittently by 60°.

Figure 18:
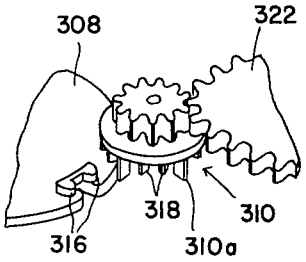
FIG. 18 is an enlarged perspective view of a third shifting pinion and related gears.

The shifting mechanism F includes a locking disk 308 molded integrally with the center shaft 296. As shown in FIG. 18, a plurality of lock teeth 310*a* of a third shift pinion 310 come in contact with the periphery of the locking disk 208. The shift pinion 310, which is supported rotatably on a small-diametered portion 314 of shaft 312 provided for the lower frame 182, includes a plurality of follower teeth 318 adapted to mesh with a segmental gear 316 on the locking disk 308. Also, shift pinion 310 is meshed with an advance gear 322 molded integrally with center shaft 320 supported rotatably between the shaft holes 268*a* and 268*b*. The center shaft 320 includes at both ends thereof clutch paws 326 in mesh with clutch paws 324 of the two cams 204 and 206 of the cam controlling mechanism Z3 corresponding to the hour display segment group Z. Accordingly, one rotation of the locking disk 308 advances intermittently the cams 204 and 206 by 30°.

The cam controlling mechanisms X3, Y3 and Z3 each include first to fourth cam followers *ab*3, *c*3, *de*3 and *fg*3 which are respectively engaged with follower pins 134, 136, 138 and 140 of first to fourth shutter blades *ab*2, *c*2, *de*2 and *fg*2 for the display segment groups X, Y and Z corresponding to the cam controlling mechanism X3, Y3 and Z3. More particularly, the first and second cam followers *ab*3 and *c*3 for controlling the vertically movable first and second shutter blades *ab*2 and *c*2 follow surface cams 328 of the cams 204 and 206 for the cam controlling mechanisms X3, Y3 and Z3. The shape of these surface cams 328 is not described herein which will be clear from the foregoing positional description of the shutter blades *ab*2 and *c*2 of FIGS. 1 and 2 with reference to FIGS. 12 and 13 and a time chart for chutter positions shown in FIG. 21 as well.

Figure 19:
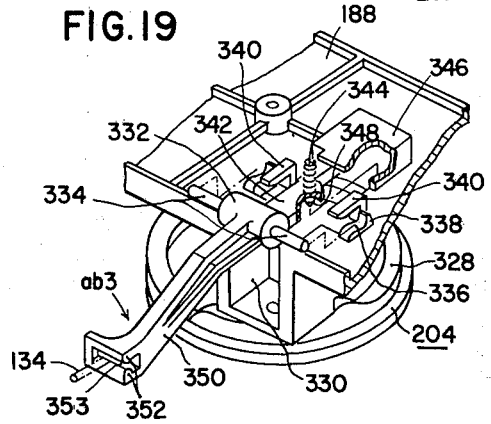
FIG. 19 is an enlarged and exploded perspective view of a mounting structure of a cam follower.

As shown in FIG. 19, in which the structure of the cam follower *ab*3 and *c*3 and mounting means therefor are explodedly illustrated in terms of the cam follower *ab*3, the cam follower *ab*3 is disposed within an elongnated space 330 extending in the forward-backward direction and defined by the cam supporting frame 188. The cam follower *ab*3 includes a horizontal column 332 received in the space 330, which column 332 is molded at both ends thereof integrally with fulcrum shafts 334. The cam supporting frame 188 has, in association with the fulcrum shaft positions, seats 338 with semi-cylindrical seat surfaces 336 for receiving the fulcrum shafts 334. Also, the cam supporting frame 188 is provided with clicks 340 in the form of letter L having flexible fingers extending above the seat surfaces 336. The cam supporting frame 188 further includes a spring receptacle 346 receiving a compressed spring 544 supported by a projection molded on an arm 342 of the cam follower ab3. The cam follower *ab*3 has a projection 348 projecting from the rear surface of arm 342 to touch the surface cam 328 of the cam 204. The cam follower ab3 also has another arm 350 extending toward the base plate 50 of display unit. In the arm 350 is formed, at the tip thereof, a channel 353 which is defined by projections 352 in the form of a semi-cylindrical column opposed vertically. Into the channel 353 is inserted the follower pin 134 of the first shutter blade *ab*2. Accordingly, while the compressed spring 344 is held in place by the rear surface of spring receptacle 346, the cam follower *ab*3 can be incorporated into the cam supporting frame 188 by focibly inserting the fulcrum shafts 334 between the clicks 340 and seats 328. The engagement of semi-cylindrical column projections 352 with follower pin 134 is effective to prevent local wear of the follower pin 134 which would result from a longtime operation, thereby preventing failure of shutter blade operation.

Figure 20:
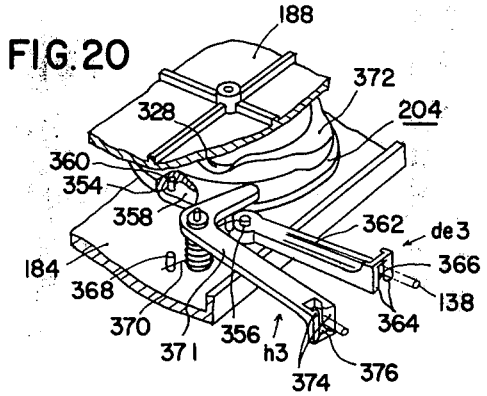
FIG. 20 is an enlarged perspective view of a mounting structure of another cam follower.

The third and fourth shutter blades *de*2 and *fg*2 follow channel cams 354 provided for cams 204 and 206 of the cam controlling mechanisms X3, Y3 and Z3 for controlling the horizontally movable third and fourth shutter blades. The structure and shape of the channel cams 354 are not described herein which will be clearly understood from the foregoing positional description of the shutter blades *de*2 and *fg*2 with reference to FIG. 14 and time chart of FIG. 21. As shown in FIG. 20, in which the structure of third and fourth cam followers *de*3 and *fg*3 and mounting means therefor are illustrated in terms of the third cam follower *de*3, the third cam follower *de*3 is rotatably supported, at its middle portion, on a vertical pin 356 molded to the upper frame 184. The cam follower *de*3 has an arm 358 extending parallel to the rear side of the channel cam 354 and the arm 358 has, at its end, a follower pin 360 to be received by the channel of the channel cam 354. The cam follower de3 also includes another arm 362 extending toward the base plate 50 of display unit. In the arm 362 is formed, at the tip thereof, a channel 366 which is defined by horizontally opposed semi-cylindrical column projections 364 into which the follower in 138 of the third shutter blade *de*2 is inserted.

The cam controlling mechanism Z3 includes a fifth cam follower *h*3 as shown in FIG. 20. The cam follower *h*3 is provided with a bias spring 370 applied between the cam follower *h*3 and a pin 368 fixed to the upper frame 184. By the spring 370, an arm 371 of the cam follower *h*3 is biased to the surface of a peripheral cam 372 of the cam 204. The cam 371 of the cam follower *h*3 extends toward the base plate of display unit and has, at its end, a channel 376 formed therein and defined by horizontally opposed semi-cylindrical column projections 374. Into the channel 376 is inserted follower pin 378 of the fifth shutter blade h2.

As will be seen from the foregoing description, the mechanical block C of the present invention is completed by incorporating gear trains of the shifting mechanism F between the lower frame 182 and upper frame 184 after the built-in of the plurality of cams 204 and 206 and the cam followers *ab*3, *c*3, *de*3 and *fg*3 between the lower frame 182 and cam supporting frame 186 and between the upper frame 184 and cam supporting frame 188. Although, in the foregoing embodiment, the cam followers *ab*3 and *c*3 for controlling vertically movable shutter blades ab2 and c2 have been engaged with the surface cams 328 and the cam followers *de*2 and *fg*2 for controlling horizontally movable shutter blades *de*2 and *fg*2 have been engaged with the channel cam 328, the well-known technique may ensure easy replacement of these cams with cylindrical channel cams or peripheral cams.

Figure 21:
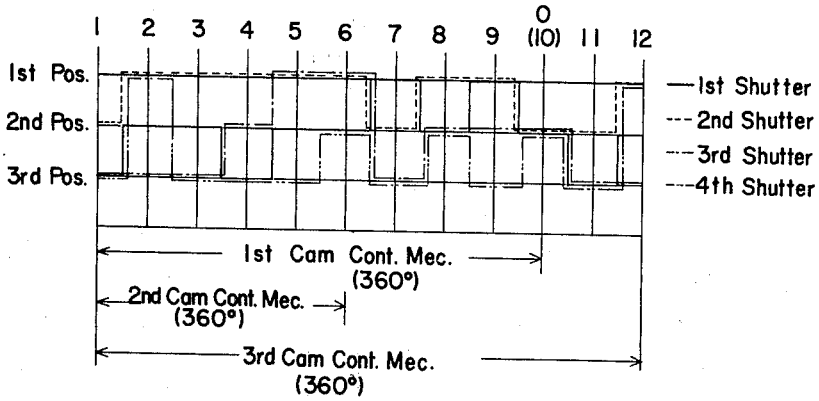
FIG. 21 is a time chart showing relation between shutter blade positions and figures to be displayed.

FIG. 21 is a time chart showing relations between the positions of the four shutter blades *ab*2, *c*2, *de*2 and *fg*2 and the rotation angles of the cams 204 and 206 of the three cam controlling mechanisms X3, Y3 and Z3 associated with the three display segment groups X, Y, Z. In FIG. 21, figures 1 to 0 to be displayed are illustrated uppermost which are expressed by positional combinations of the four shutter blades *ab*2, *c*2, *de*2 and *fg*2. For example, to display figure 5 the second and third shutter blades c2 and *de*2 are positioned at the first position of FIG. 13 or 14 as above described, the first shutter blade ab2 at the second position of FIG. 12 and the fourth shutter blade *fg*2 at the third position of FIG. 14, respectively. In this condition, only the segmental openings *e* and *f* are closed so that the light beam from lamp 168 is seen through the segmental openings *a*, *b*, *c*, *d* and *g*.

Turning to FIG. 5, the shifting mechanism F includes a timer driving gear 380 at center shaft 296. The timer driving gear 380 is method with follower teeth 386 of intermediate gear 384 supported rotatably on a large-diametered portion 382 of the shaft 312. The intermediate gear 384 includes driven teeth 390 in mesh with follower teeth 388*a* of a first reduction gear 388 which is free for rotation from the center shaft 320. The first reduction gear 388 includes driver teeth 388*b* in mesh with a large-diameter follower teeth 398 of first reduction gear 396 freely rotatably supported on a largediameter portion 394 of shaft 392.

Driver teeth 400 of the reduction gear 396 is engaged with a second reduction gear 406 supported on a shaft 404 molded to an extension 402 of the lower frame 182 as shown in FIG. 22. As shown in FIG. 22, showing an exploded view of the timer G and the sleep mechanism H, the reduction gear 406 includes follower teeth 408 in mesh with the driver teeth 400 and driver teeth 414 for driving a timer gear 412 supported on a shaft 410 provided for the extension 402.

The timer gear 412 of timer G is so supported on the shaft 410 as to be slidable in the axial direction of the shaft 410 and rotatable around the shaft 410. The timer G has, on its upper surface, a plurality of projections 416 which are disposed in different angular and radial directions. Also, the timer G includes an auxiliary numerical wheel 80 of semi-transparent synthetic resin supported rotatably on the shaft 410. The auxiliary numerical wheel, which is prevented from being removed from the shaft 410 by means of an extension 418 of the upper frame 184, includes a plurality of arcuate holes 420 formed in the bottom wall 422 corresponding to the projections 416. The auxiliary numerical wheel 80 with a manual operation shaft 424 has a number of teeth 428 formed in the upper edge of its peripheral wall 426, and a click paw 430 shown in FIG. 2 actions on the teeth 428. The click paw 430 is cantilevered within a window 432 formed in extension 418 of the upper frame 184 and a tip projection of the click paw 430 is resiliently engaged with one of teeth 428 of the auxiliary numerical wheel 80. On the periphery of the wheel 80 are formed a plurality of display figures 434 which are printed on the peripheral wall 426 by hot printing and the like. In the extension 418 of the upper frame 184 is formed a window 436 (FIG. 2) facing the auxiliary numerical wheel 80. In front of the window 436 stand paired arcuate resilient paws 438 in which the lamp 180 connected to the printed circuit board 152 is held resiliently. Accordingly, the auxiliary numerical wheel 80 to be seen through the rectangular window K1 is illuminated by the light of the interior lamp 180 facing the window 432.

Figure 2:
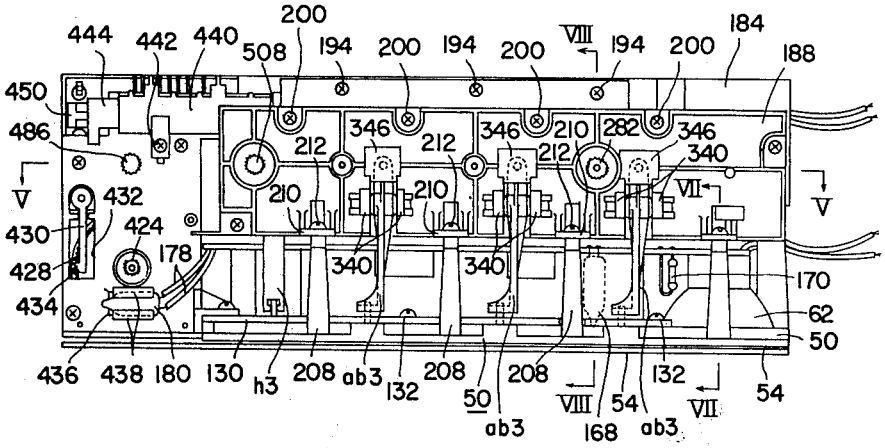
FIG. 2 is a top view of the digital clock.
Figure 24:
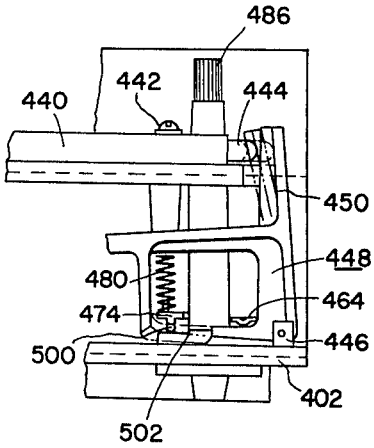
Figure 25:
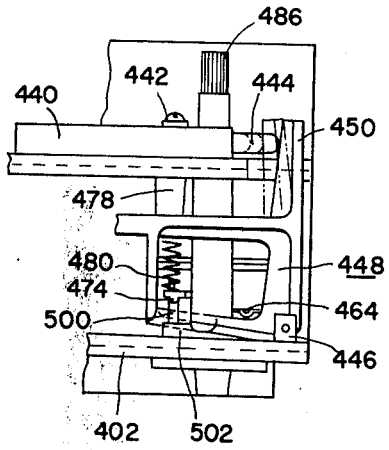

The timer G, as shown in FIGS. 2 and 9, includes a slide switch 440 which is fixed to the extension 418 of the upper frame 184 by means of screws 442. The slide switch 440 includes a pusher 444 biased by a built-in spring (not shown) toward projective direction, i.e. to the left as viewed in FIG. 2, which pusher 444 closes a power source circuit for radios or television receiver sets used together with the digital clock when depressed to the extreme (first position) shown in FIG. 23. The pusher 444 can take, as shown in FIG. 24 at solid line, a neutral position (second position) at which the power source circuit for radios or television receiver sets is opened. Also, the pusher 444 can take, as shown in FIG. 25, a third position at which a buzzer switch incorporated in the slide switch, other than a switch incorporated in the power source circuit for the radios, is closed. Needless to say, by providing make-contacts or break-contacts to be actuated between the first and second positions, the slide switch 440 can be used with other electrical apparatus.

Referring to FIG. 22, the timer G includes a switch actuating member 448 so journaled by paired posts 446 standing on an extension 402 of the lower frame 182 as to be inclined. The switch actuating member includes a first cam 450 extending substantially vertically to be engaged with the pusher 444 of the slide switch 440 and a second arm 452 extending substantially horizontally along the rear edge of the lower frame 182. The timer G also includes a controlling member 456 journaled rotatably by paired posts 454 opposed in the forward-backward direction on the extension 402 of the lower frame 182. The controlling member 456 includes a first cam 462 extending in the right-left direction to terminate in a projection 460 which is engaged with the lower surface of a boss 458 of the timer gear 412 and a second arm 464 extending in the forward-backward direction toward the second arm 452 of switch actuating member 448 so that the tip of the second arm 464 is engaged with the upper surface of the second arm 452 of the switch actuating member 448. On the other hand, the timer G includes paired posts 466 opposed in the right-left direction on the extension 402 of the lower frame 182 and the middle portion of a suppression member 468 is journaled rotatably by the paired posts 466. The suppression member 468 includes a first arm 470 extending in the forward-backward direction to terminate in a projection 472 which is engaged with the lower surface of the boss 458 of timer gear 412. Also, the suppression member 468 includes a second arm 474 extending toward the second arm 452 of the switch actuating member 448 until the tip of the second arm 474 is engaged with the upper surface of the second arm 452 of the switch actuating member 448. The second arm 474 of suppression member 468 has a projection 476 with which one end of a compressed spring 480 is engaged, the other end being fixed to a rod 478 (shown in FIG. 3) extending downwardly from the upper frame 184. Furthermore, the timer G includes a selector shaft 486 journaled by a small hole 482 formed in the extension 402 of the lower frame 182 and a shaft hole 484 formed in the extension 418 of the upper frame 182. In the upper surface of the extension 402 of the lower frame 182 are formed semi-circular recesses 488 and 490 of different diameters. The small hole 482 is surrounded by the recesses 488 and 490 and an elongaged leaf spring 492 as a click is disposed therebetween. The selector shaft 486 is provided with a square-section stem 494 cooperative with the leaf spring 492 so that it is possible for the selector shaft 486 to take four different positions with 90° interval, which will be described later with reference to FIGS. 23 to 25. The selector shaft 486 includes a projection 498 in engagement with an inclined cam projection 496 projecting from the side of the second arm 464 of the controlling member 456, and the projection 498 makes engagement with the upper surface of the cam projection 496 to depress downwardly the controlling member 456 when the selector shaft is positioned at a first position to be described later. The selector shaft 486 also includes a surface cam 502 which is engaged with a follower projection 500 provided on the lower surface of the arm 474 of suppression member 468. The surface cam 502 elevates the suppression member 468 slightly, when the selector shaft 486 is positioned at a second position to be described later, to retain the pusher 444 of the slide switch 440 at the second position. When the selector shaft 486 is positioned at a fourth position to be described later, the surface cam 502 elevates the suppression member 468 to allow the pusher 444 of slide switch to move to the third position.

Figure 23:
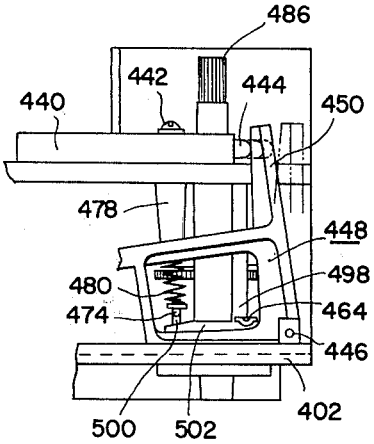
FIGS. 23 to 25 are partial rear side views useful to explain operation of the timer.

In FIG. 23, the selector shaft 486 is positioned at the first position, i.e. it is turned clockwise, as viewed in FIG. 2, to the extreme. Under this condition, the projection 498 of selector shaft 486 engages the upper surface of the cam projection 476 of controlling member 456 to depress the controlling member 456 downwardly. Therefore, the switch actuating member 448 is turned counterclockwise, as viewed in FIG. 23, by means of the arm 474 of controlling member 468 and as a result, the pusher 444 of slide switch 440 is moved forcibly to the first position. This causes the power source circuit for radios and the like to be closed irrespective of the relative position of auxiliary numerical wheel 80 to the timer gear 412.

In FIG. 24, the selector shaft 486 is positioned at the second position, i.e. it is turned counterclockwise, as viewed in FIG. 2, through 90° from the first position. Under this condition, the pusher 444 of slide switch 440 tends to move to the third position by virtue of the built-in spring but the arm 462 of controlling member 468 is suppressed by the timer gear 412 so that the arm 464 of controlling member 468 stops the switch actuating member 448. Therefore, the pusher 444 of slide switch 440 is positioned at the second position, thereby causing the power source circuit to be opened. Also, in this condition, the projections 416 of timer gear 412 are aligned with the arcuate channels 420 of auxiliary numerical wheel 80 and the timer gear 412 will move upwardly; but, since the suppression member 468 is slightly elevated by the surface cam 502 of selector shaft 486, the switch actuating member 448 is stopped by the arm 474 of suppression member 468. As a result, at this position, the pusher 444 of slide switch 440 is retained at the second position irrespective of the relative position of the timer gear 412 to the auxliary numerical wheel 80.

When the selector shaft 486 is positioned at the third position deviated from the second position through 90°, the suppression member 468 is not affected by the surface cam 502. Therefore, although the timer gear 414 tends to be elevated by a force due to the compressed spring 480 acting on the suppression member 468, the projections 416 of timer gear 412 are suppressed by the bottom of auxiliary numerical wheel 80 and thus the pusher 444 of slide switch 440 is retained at the second position shown in FIG. 24. Next, when a setting time is reached and the arcuate channels 420 of auxiliary numerical wheel 80 are aligned with the projections 416 of timer gear 412, the suppression member 468 is depressed by compressed spring 480 and the switch actuating member 448 is turned counterclockwise as viewed in FIG. 24. As a result, the pusher 444 of slide switch 440 is moved to the first position. In other words, with the selector shaft 486 positioned at the third position, radios and the like are turned on at the time determined by setting of the auxiliary numerical wheel 80.

In FIG. 25, the selector shaft 486 is positioned at the fourth position, i.e. turned counterclockwise to the extreme as viewed in FIG. 2. Under this condition, the suppression member 468 is elevated by the surface cam 502, i.e., it is positioned outside the movement range of the switch actuating member 448. However, before a setting time is reached, the switch actuating member 448 is suppressed by the suppression member 456 as in FIG. 24 so that the pusher 444 of slide switch 440 is positioned at the second position. Then, when the setting time is reached and the projections 416 of timer gear 412 are aligned with the arcuate channels 420 of auxiliary numerical wheel 80, the suppression of the switch actuating member 448 by the controlling member 456 is released so that the pusher 444 is moved by the slide switch buit-in spring to the third position shown in FIG. 3, thereby energizing the buzzer coupled with contacts of the slide switch 440 to announce a scheduled time.

Turning to FIGS. 5 and 22, the sleep mechanism H of the digital clock according to the invention will be described. The sleep mechanism H includes a manually operated sleep shaft 508 which is supported between a small-diameter portion 504 of the shaft 392 and a shaft hole 506 of the upper frame 182. The sleep shaft 508 has a selector gear 514 which is allowed to be manually meshed with a first pinion 512 of interlocking mechanism 510 to be described later. The sleep shaft 508 also includes a bias spring 518 applied between a pin 516 provided for the selector gear 514 and the upper frame 182, and the selector gear 514 is subjected to a counterclockwise rotatable tendency, as viewed from the top in FIG. 22, by means of the bias spring 518. Accordingly, in normal operation, the pinion 512 is communicated with a depression 520 of the selector gear 514 so that the selector gear is prevented by the pinion 512 to turn. The interlocking mechanism 50 has a shaft 522 journaled freely rotatably by the upper and lower frames 184 and 182. Between a flange of the shaft 522 and a G-washer 524 at the other end are interposed, in a freely rotatable manner, a second pinion 526 always in mesh with the follower teeth 398 of the second reduction gear 396 and the first pinion 512. Also, mounted to the shaft 522 is a compressed spring 528 which is interposed between the pinions 512 and 526. Consequently, the pinions 512 and 526 are coupled frictionally with the shaft 522 by the compressed spring 528 and allowed to rotate together with the shaft 522. Further, the sleep mechanism H includes a cylindrical cam 530 integrally molded with the lower portion of selector gear 514, with which cam 530 a tip paw 534 of the third arm 532 extending from the switch actuating member 448 of the timer G. is engaged.

Accordingly, during operation of the digital clock, both the pinions 512 and 526 are rotated along with the shaft 522 by means of the third reduction gear 396, but the selector gear 514 is prevented to rotate since the pinion 512 is communicated with the depression 520 of selector gear 514. The sleep mechanism H is put to use when the selector shaft 486 is positioned at the above-mentioned second, third or fourth position. More particularly, by turning by a desired angle the sleep shaft 508 against the bias spring 518 in the clockwise direction as viewed in FIG. 2, the selector gear 514 is brought into mesh with the pinion 512. Under this condition, the tip paw 534 of switch actuating member 448 follows the inclined surface of the cylindrical cam 510 so that the switch actuating member 448 is turned to the position shown in FIG. 23 and the pusher 444 of slide switch 440 is moved to the first position. In other words, the power source circuit of radios related to the digital clock is closed. Next, when a scheduled time has elapsed, the selector gear 514 is returned by the pinion 512 rotatable along with the pinion 526, and the switch actuating member 448 is released so that the pusher 444 of slide switch 440 is returned to the second position shown in FIG. 24. As a result, the power source circuit of radios related to the digital clock is opened automatically.

Although the invention has been shown and described in terms of a preferred embodiment thereof, it will be understood that many changes and modifications may be made within the spirit and scope of the invention as defined in the appended claims.

What is claimed is:

1. A shutter type digital clock comprising a display unit base plate in which a plurality of display segment groups each having a plurality of display segmental openings arranged in the form of a figure "8" are formed, a plurality of shutter units disposed behind said base plate for switching said display segmental openings, a plurality of controlling mechanisms for controlling mechanical positions of shutter blades of said shutter units in association with a time-identified shifting mechanism, and interior light sources disposed behind said shutter blades for internally illuminating said display segmental openings, wherein each of said plurality of shutter units associated with respective display segment groups comprises a first shutter blade substantially vertically movable for switching an upper segmental opening and a lower segmental opening of said display segmental openings, a second shutter blade substantially vertically movable for switching an intermediate segmental opening of said display segmental openings, a third shutter blade substantially horizontal movable for switching an upperright segmental opening and an upper-left segmental opening of said display segmental openings, and a fourth shutter blade substantially horizontally movable for switching a lower-right segmental opening and a lower-left segmental opening of said display segmental openings.

2. The shutter type digital clock according to claim 1, wherein said third and fourth shutter blades are disposed on the same plane.

3. The shutter type digital clock according to claim 2, wherein said display unit base plate comprises a pair of vertical blocks embossed from the rear surface thereof and extending substantially vertically so as to surround said upper-right and left segmental openings and lower-right and left segmental openings, a supporting guide block embossed from the rear surface of said base plate to surround said intermediate segmental opening and having a height less than that of said paired vertical blocks, and a pair of guide walls embossed from the rear surfaces of said paired vertical blocks so as to extend substantially horizontally between said upper-right and left segmental openings and said lower-right and left segmental openings, whereby said first and second shutter blades are guided in substantially the vertical direction by side surfaces of said paired vertical blocks, said third and fourth shutter blades are guided in substantially the horizontal direction, and said first, second and third shutter blades are supported on different planes close to each other in the forward-backward direction by means of the rear surface of said display unit base plate, rear surface of said supporting guide block and rear surfaces of said paired vertical blocks, respectively.

4. The shutter type digital clock according to claim 3, wherein said first shutter blade comprises a rectangular frame of transparent plate material applied with a first blind for switching said upper segmental opening and second and third blinds for switching said lower segmental opening, said second shutter blade comprises a rectangular transparent plate applied with one blind for switching said intermediate segmental opening, said third shutter blade comprises an opaque plate material in the form of a reversed U-letter having two sides for switching said upper-right and left segmental openings, and said fourth shutter blade comprises an opaque plate material in the form of a U-letter having two sides for switching said lower-right and left segmental openings.

5. A shutter type digital clock comprising a display block adapted to display figures by switching a plurality of display segmental openings of a plurality of display segment groups by means of positional controlling of a plurality of builtin shutter units, a light source block disposed behind said display block for illuminating the figures to be displayed, and a mechanical block incorporated with a driver unit, shifting mechanism driven thereby and a plurality of cam controlling mechanisms for controlling said shutter units in association with said shifting mechanism, said display block including a display base plate, said light source block comprising a lamp house partitioned into a plurality of lamp chambers, a plurality of lamps located within said lamp chambers and a pair of light conductive members housed in said lamp house, one end of the light conductive member being associated with at least one of the lamps located within said lamp chambers, the other end of the light conductive member reaching an hour discriminating opening formed in said display base plate, whereby said hour discriminating opening is illuminated by a part of light quantity from said at least one lamp.

6. A shutter type digital clock comprising a display block adapted to display figures by switching a plurality of display segmental openings of a plurality of display segment groups by means of positional controlling of a plurality of built-in shutter units, a light source block disposed behing said display block for illuminating the figures to be displayed, and a mechanical block incorporated with a driver unit, shifting mechanism driven thereby and a plurality of cam controlling mechanisms for controlling said shutter units in association with said shifting mechanism, said display block comprising a display base plate and an operation indicator unit supported by the display base plate, said operation indicator unit including a holder in the form of a semisperical cell formed integral with said display base plate and having a cylinder supported therein, a hollow rotor housed in said holder and supported rotatably by said cylinder, a lamp connected with a printed circuit board of said light source block and inserted into said cylinder, and a driver gear meshed with teeth of said rotor exposed outside through a cutting formed in said holder and driven by said driver unit of said mechanical block.

7. A shutter type digital clock comprising a display block adapted to display figures by switching a plurality of display segmental openings of a plurality of display segment groups by means of positional controlling of a plurality of built-in shutter units, a light source block disposed behind said display block for illuminating said figures to be displayed, and a mechanical block incorporated with a driver unit, shifting mechanism driven thereby and a plurality of cam controlling mechanisms for controlling said shutter units in association with said shifting mechanism, wherein said mechanical block includes a lower frame and an upper frame fixed to each other in a vertically spatial relationship, a first cam supporting frame fixed to the lower surface of said lower frame in a spatial relationship thereto, a second cam supporting frame fixed to the upper surface of said upper frame in a spatial relationship thereto, the shifting mechanism incorporated within a first space defined by said upper and lower frames, and a plurality of cams incorporated within a second space defined by said lower frame and first cam supporting frame and within a third space defined by said upper frame and second cam supporting frame, said plurality of cams being comprised by said cam controlling mechanisms coupled with preselected members of said shifting mechanism through paw clutches.

8. The shutter type digital clock according to claim 7, wherein said shifting mechanism includes a plurality of locking disks which are supported on shafts coupled with said cams and provided with digit advance segmental gears, and a plurality of shifting pinions having locking teeth in engagement with the periphery of said locking disks.

9. The shutter type digital clock according to claim 7, wherein said mechanical block comprises a timer incorporated within a space defined by said lower frame and upper frame, said timer including an auxiliary numerical wheel for displaying a setting time, a timer gear driver by said shifting mechanism and movable toward said auxiliary numerical wheel, a switch having a pusher movable to three positions adjacent to each other in the movement direction, a switch actuating member supported on the stationary part of said timer in an inclination-free fashion and having inclination tendency in one direction, a controlling member interposed between said timer gear and said switch actuating member which retains said pusher at a second position by disabling said switch actuating member in opposition to said inclination tendency before a setting time is reached, a suppression member interposed between said timer gear and said switch actuating member which has movable tendency for retaining said pusher at a first position in opposition to said inclination tendency, and a selector shaft manually operated such that, under positional control of said controlling and suppression members, said pusher is locked at the first and second positions or is moved from the second position to the first position or to a third position.

10. The shutter type digital clock according to claim 9, wherein said mechanical block comprises a sleep mechanism incorporated within a space defined by said lower frame and upper frame, said sleep mechanism including a cam integral with a selector gear rotatable in one direction and manually operated, and a follower arm extending from said switch actuating member of said timer and associated with said cam, whereby when said selector gear is set manually, said switch pusher is returned to the first position from the second position by means of said cam.

* * * * *